US008369720B2

(12) United States Patent
Ohba et al.

(10) Patent No.: US 8,369,720 B2
(45) Date of Patent: Feb. 5, 2013

(54) POWDER CONTAINER APPARATUS AND IMAGE FORMING APPARATUS

(75) Inventors: Tetsuya Ohba, Ibaraki (JP); Hidenori Iwanaga, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 509 days.

(21) Appl. No.: 12/638,324

(22) Filed: Dec. 15, 2009

(65) Prior Publication Data

US 2010/0196021 A1 Aug. 5, 2010

(30) Foreign Application Priority Data

Jan. 30, 2009 (JP) ..... 2009-020589
Oct. 30, 2009 (JP) ..... 2009-249819

(51) Int. Cl.
*G03G 21/00* (2006.01)
*G03G 21/12* (2006.01)

(52) U.S. Cl. ..... 399/35; 399/358; 399/360

(58) Field of Classification Search ..... 399/35, 399/123, 360
See application file for complete search history.

(56) References Cited

U.S. PATENT DOCUMENTS

| | | | | |
|---|---|---|---|---|
| 4,868,599 | A * | 9/1989 | Niki | 399/35 |
| 5,021,825 | A * | 6/1991 | Niki | 399/111 |
| 5,038,180 | A * | 8/1991 | Niki | 399/360 |
| 5,257,076 | A * | 10/1993 | Nishimura et al. | 399/27 |
| 5,530,521 | A * | 6/1996 | Lee | 399/29 |
| 5,781,841 | A * | 7/1998 | Kouroku et al. | 399/360 |
| 6,505,009 | B2 * | 1/2003 | Henricus et al. | 399/35 |
| 6,904,249 | B2 * | 6/2005 | Kato et al. | 399/120 |
| D559,893 | S * | 1/2008 | Kouroku et al. | D18/40 |
| 7,865,092 | B2 * | 1/2011 | Murata et al. | 399/35 |
| 2003/0016957 | A1 * | 1/2003 | Anthony et al. | 399/35 |
| 2004/0033094 | A1 * | 2/2004 | Saito et al. | 399/360 |
| 2009/0022532 | A1 * | 1/2009 | Fukunaga et al. | 399/360 |

FOREIGN PATENT DOCUMENTS

| | | |
|---|---|---|
| JP | 2-284190 | 11/1990 |
| JP | 2-287482 | 11/1990 |
| JP | 2-293886 | 12/1990 |
| JP | 3-59585 | 3/1991 |
| JP | 5-35160 | 2/1993 |
| JP | 8-160822 | 6/1996 |

(Continued)

OTHER PUBLICATIONS

Machine translation of JP 2001022241 A.*

*Primary Examiner* — Walter L Lindsay, Jr.
*Assistant Examiner* — David Bolduc
(74) *Attorney, Agent, or Firm* — Oblon, Spivak, McClelland, Maier & Neustadt, L.L.P.

(57) ABSTRACT

A powder container apparatus for containing a powder material removed from a cleaned body using a cleaning unit includes a casing having an opening at the top; a collecting bag made of a soft and freely deformable material detachably disposed within the casing, the collecting bag being configured to contain the powder material that is dropped via the opening of the casing; a displaced member disposed between the collecting bag and the casing and configured to be horizontally displaced by the collecting bag when the collecting bag is inflated by the powder material contained in the collecting bag; a displacement amount detecting unit configured to detect the displacement of the displaced member; and a collected amount detecting unit configured to determine a collected amount of the powder material in the collecting bag based on the horizontal displacement of the displaced member detected by the displacement amount detecting unit.

12 Claims, 9 Drawing Sheets

FOREIGN PATENT DOCUMENTS

| | | | | |
|---|---|---|---|---|
| JP | 10039601 | A | * | 2/1998 |
| JP | 11-15344 | | | 1/1999 |
| JP | 2001022241 | A | * | 1/2001 |
| JP | 2002-169436 | | | 6/2002 |
| JP | 2004-286790 | | | 10/2004 |
| JP | 3708448 | | | 8/2005 |
| JP | 2007108416 | A | * | 4/2007 |
| JP | 2009-63772 | | | 3/2009 |

* cited by examiner

POWDER CONTAINER APPARATUS AND IMAGE FORMING APPARATUS

BACKGROUND OF THE INVENTION

1. Field of the Invention

The present invention generally relates to a powder container apparatus for an image forming apparatus, such as copy machines, facsimiles, and printers, and to an image forming apparatus equipped with such a powder container apparatus.

2. Description of the Related Art

Image forming apparatuses having image carriers, such as a photosensitive body or an intermediate transfer body, typically also include a cleaning device for collecting residual toner on the image carrier. The waste toner collected by the cleaning device is usually sent to a waste toner container provided within the main body of the image forming apparatus. Such a waste toner container is typically detachable from the apparatus main body of the apparatus, so that, when full, the waste toner container can be detached and emptied or replaced with a new container.

Japanese Laid-Open Patent Application No. 2-293886 ("Patent Document 1") discloses an image forming apparatus in which an electrostatic latent image formed on the surface of a photosensitive drum as a latent image carrier is developed with a developing unit. A resultant toner image is then transferred from the photosensitive drum to a transfer medium, such as a sheet of paper. Residual toner remaining on the surface of the photosensitive drum after the transfer step is removed by a scraping blade and put into the waste toner container. Further, based on the cumulative count of the number of pixels in output images, the amount of remaining toner on the surface of the photosensitive drum is calculated, and it is determined whether the waste toner container is full based on an accumulated result of such calculations.

Japanese Laid-Open Patent Application No. 2002-169436 ("Patent Document 2") discloses that the amount of waste toner collected in the waste toner container is estimated from values calculated from print parameters (such as density and the number of pages).

Japanese Laid-Open Patent Application No. 2004-286790 ("Patent Document 3") discloses an image forming apparatus having a waste toner container for collecting waste toner recovered by a cleaning device. A portion of the side wall of the waste toner container protrudes outward, forming a waste toner detecting space separate from the waste toner container space. The waste toner detecting space is in fluid communication with the waste toner container space so that, when the waste toner container space is full, waste toner can exit the waste toner container space and enter the waste toner detecting space. Two opposite side walls of the waste toner detecting space include light-transmitting areas. A light-emitting portion and a light-receiving portion of an optical sensor unit are disposed opposite to each other on the outer surfaces of these two opposite side walls of the waste toner detecting space. As the waste toner container space is filled with waste toner, the waste toner then begins to enter the toner detecting space. As a result, a ray of light emitted by the light-emitting portion toward the light-receiving portion through the toner detecting space is blocked by the waste toner. In this way, a filled-state of the waste toner container can be detected.

Japanese Laid-Open Patent Application Nos. 3-59585 ("Patent Document 4") and 2-284190 ("Patent Document 5") disclose that a detecting unit including a displaceable mechanical sensor is mounted above a waste toner container that is capable of at least partial deformation. As waste toner is collected, the waste toner container inflates and its wall surfaces displace the mechanical sensor, thus indicating that the waste toner container is full.

Japanese Laid-Open Patent Application No. 5-35160 ("Patent Document 6") discloses that the weight of a waste toner container is measured using a weight measuring mechanism in order to determine whether the waste toner container is full.

Japanese Laid-Open Patent Application No. 8-160822 ("Patent Document 7") discloses a displacement amount detecting unit mounted on a bottom surface of a waste toner container. The displacement amount detecting unit measures the amount of downward displacement of the toner container relative to a predetermined position as the container's weight increases with increasing amounts of waste toner collected therein. Based on a detection result, whether the waste toner container is full is determined.

The techniques of Patent Documents 1 and 2 do not involve a direct measurement of waste toner in the waste toner container. Thus, the calculation results do not necessarily reflect an accurate amount of waste toner in the waste toner container. For example, the amount of waste toner may actually be much below the full amount when the calculation result indicates that the waste toner container is full. Conversely, the waste toner container may actually be full when the calculation result does not indicate the filled state. In the latter case, if more waste toner is collected, the collected waste toner may flow out of the waste toner container. Thus, whether a certain amount of waste toner has been collected in the waste toner container cannot be accurately determined.

In the case of Patent Document 2, because the monitoring is based on a control routine, the image forming apparatus could be fed with an instruction from a user causing the image forming apparatus into determining that the waste toner container that has been filled has been replaced when in fact it has not been. In this case, the already filled waste toner container may continuously be used, with the resultant overflow of waste toner from the waste toner container, possibly causing contamination of the areas around the apparatus.

In the case of Patent Document 3, waste toner that floats around within the toner casing may attach to the side walls of the waste toner container space. Such attached waste toner may block the ray of light travelling from the light-emitting portion to the light-receiving portion of the optical sensor when the waste toner container space is not yet filled with waste toner, thus resulting in false detection of the filled-up state even before waste toner flows out of the toner container space and enters the toner detecting space.

In Patent Document 4 or 5, where the detector is disposed above the toner container, the detection of the waste toner amount is based on the toner immediately below the detector. However, the toner is not necessarily collected uniformly within the toner container, thereby potentially resulting in false detection of waste toner.

In Patent Document 6 or 7, involving the detection of the weight of the waste toner container, although there is a certain correlation between the waste toner amount and the detected weight, the measurement of waste toner may be inaccurate if some of the toner within the waste toner container is unevenly distributed. In such a case, detection is inaccurate. Further, in Patent Document 7 involving a suction system, a paper container for collecting waste toner is sucked toward the sucking end (such as above), which may prevent an accurate detection of weight. In addition, if the paper container is caught on the casing, the paper container fails to drop, thereby preventing the detection of its weight. In order to prevent such a potential problem, some slack needs to be provided in the space between the paper container and the casing. As a result, the size of the apparatus increases. The use a weight detector also increases cost and size of the apparatus.

SUMMARY OF THE INVENTION

In one aspect of the present invention, a powder container apparatus for containing a powder material removed from a cleaned body using a cleaning unit includes a casing having an opening at the top; a collecting bag made of a soft and freely deformable material detachably disposed within the casing, the collecting bag being configured to contain the powder material that is dropped via the opening of the casing; a displaced member disposed between the collecting bag and the casing and configured to be horizontally displaced by the collecting bag when the collecting bag is inflated by the powder material contained in the collecting bag; a displacement amount detecting unit configured to detect the horizontal displacement of the displaced member; and a collected amount detecting unit configured to determine a collected amount of the powder material in the collecting bag based on the horizontal displacement of the displaced member detected by the displacement amount detecting unit.

In another aspect of the present invention, an image forming apparatus includes an image carrier; a cleaning unit configured to remove a powder material from a surface of the image carrier; and a powder collecting unit configured to collect the powder material removed by the cleaning unit. The powder collecting unit includes the above-described powder container apparatus.

BRIEF DESCRIPTION OF THE DRAWINGS

These and other aspects of the invention will become apparent from the following description of the preferred embodiments taken in conjunction with the following drawings in which.

DETAILED DESCRIPTION OF THE PREFERRED EMBODIMENTS

Figure 1:
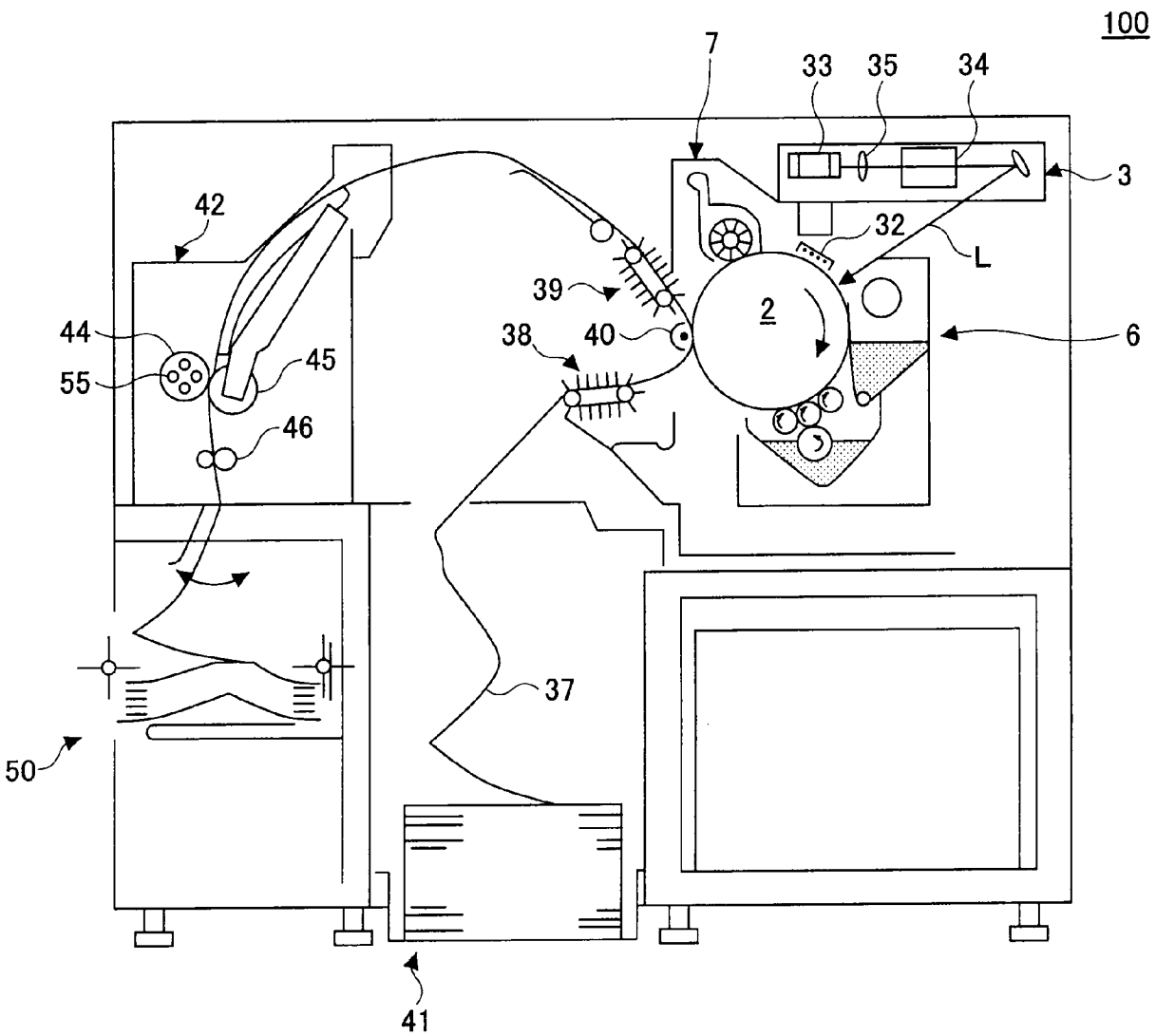
FIG. 1 is a schematic diagram of an image forming apparatus according to an embodiment of the present invention.

Referring now to the drawings, wherein like reference numerals designate identical or corresponding parts throughout the several views, FIG. 1 depicts an image forming apparatus 100 according to an embodiment of the present invention. After a surface of a photosensitive body 2 is uniformly charged with a corona charger 32, the photosensitive body 2 is exposed to a write beam of light L from a write unit 3 including a rotating polygon member 33, a light source 34, and an fθ lens 35, whereby an electrostatic latent image is formed on the photosensitive body 2. A developing unit 6 then causes a toner powder to electrically attach to the electrostatic latent image on the photosensitive body 2, thereby visualizing the latent image.

The visible toner image on the photosensitive body 2 is then transferred to a transfer sheet 37, such as a sheet of paper, by a transfer unit 40. The transfer sheet 37 is transported from a transfer sheet hopper 41. Specifically, the transfer unit 40 produces a corona discharge from a back surface (which is not to be printed) of the transfer sheet 37, thus producing an electric field. Because the visible toner image on the photosensitive body 2 is charged, corresponding charges are fed to the back surface of the transfer sheet 37 so that the electric field can be formed over the entire layer of toner. The toner is transferred onto the transfer sheet 37 where the coulomb force due to the electric field exceeds the bonding force between the photosensitive body 2 and the toner on it.

However, not all of the toner powder on the photosensitive body 2 is transferred and a small amount of toner remains attached on the photosensitive body 2. Unless such residual toner is removed, the previous image may appear as a ghost image on the subsequent pages. Thus, the surface of the photosensitive body 2 is cleaned by a cleaner unit 7 to remove the residual toner. The removed residual toner may be hereafter referred to as "waste toner".

The transfer sheet 37 is further transported by transfer sheet transport units 38 and 39 via a transfer unit 40 to a fusing apparatus 42. In the fusing apparatus 42, the transfer sheet 37 is pre-heated from its back surface by a pre-heater (not shown) which may include a heater and a temperature detecting sensor for maintaining a certain temperature of the heater. The thus pre-heated transfer sheet 37 is then transported while held between a heating roller 44 and a pressing roller 45 that are installed within the fusing apparatus 42. The heating roller 44 may contain a heating lamp 55 and may be coated with a high-releasability material. The pressing roller 45 may be coated with a resilient material. The toner powder is fused on the transfer sheet 37 by heat and pressure provided by the heating roller 44 and the pressing roller 45. The heating roller 44 may include a drive source (not shown) in order to transport the transfer sheet 37 by the rotation of the heating roller 44. The transfer sheet 37 is further transported by a transfer sheet feeding roller 46 out of the fusing apparatus 42 and eventually ejected into a transfer sheet stacker 50.

Figure 2:
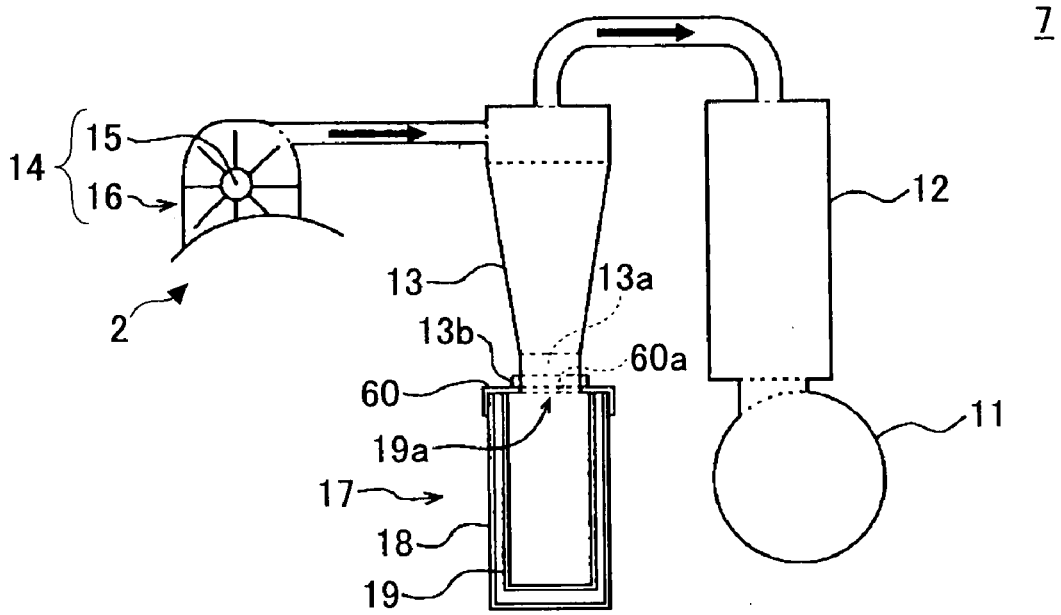
FIG. 2 depicts a cleaner unit according to an embodiment of the present invention.

FIG. 2 depicts a cleaner unit 7 according to an embodiment of the present invention. The cleaner unit 7 may include a blower 11, a filter 12, a cyclone filter 13, a brush unit 14, and a collecting unit 17. The brush unit 14 includes a brush 15 and a housing 16 surrounding the brush 15. The brush 15 is disposed in slidable contact with the surface of the photosensitive body 2. Waste toner attached to the surface of the photosensitive body 2 is scraped by the brush 15. The waste toner that floats within the housing 16 after being removed from the photosensitive body 2 is sucked into the cyclone filter 13 by a sucking flow of air produced by the blower 11. The thus sucked waste toner is separated by the cyclone filter 13, and approximately 90% by weight of the waste toner is collected in the collecting unit 17. The remaining 10% by weight of the waste toner is collected by the filter 12.

Figure 3:
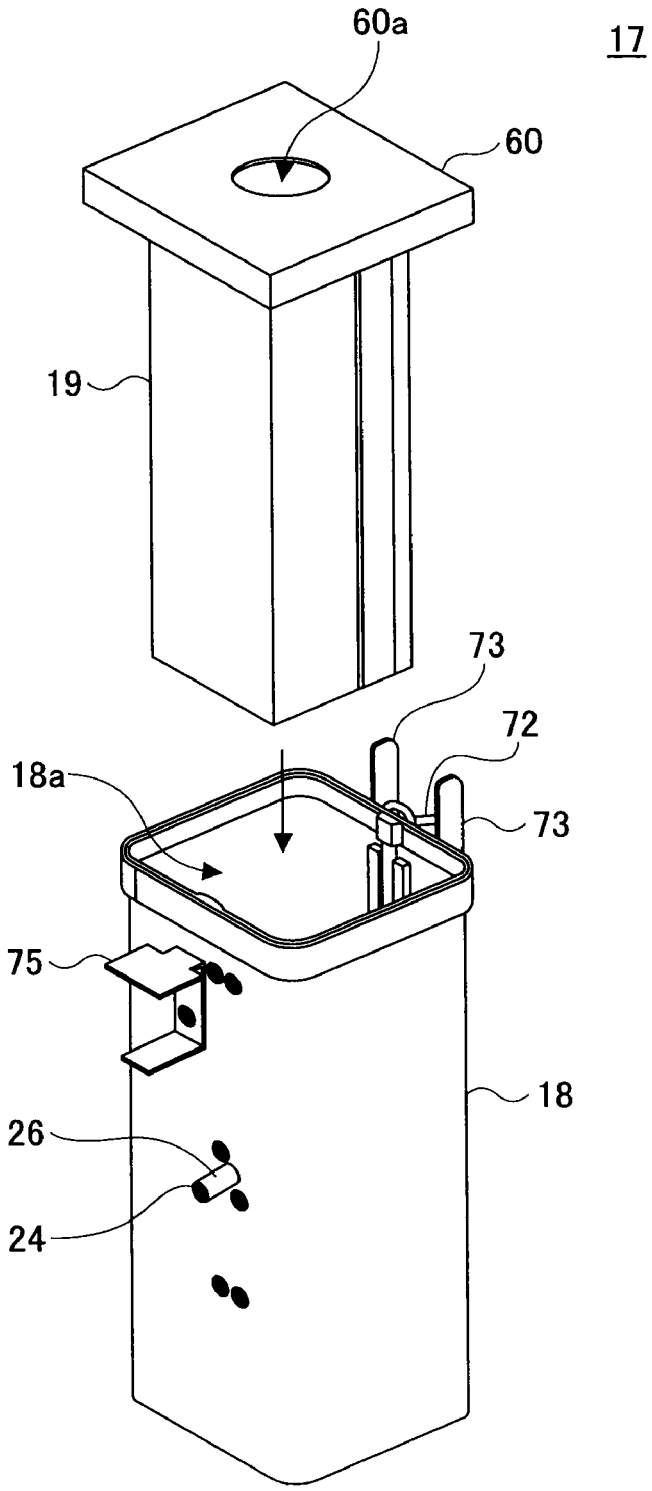
FIG. 3 depicts a collecting unit according to an embodiment of the present invention.

FIG. 3 depicts the collecting unit 17. The collecting unit 17 includes a casing 18 and a collecting bag 19. The collecting bag 19 has an opening 19*a* at the top (see also FIG. 2). The opening 19*a* is covered with a rectangular lid 60 which may be made of cardboard and having a circular opening 60*a*, as depicted in FIG. 3. The collecting bag 19 with the lid 60 attached as depicted is inserted into the casing 18 via an opening 18*a* of the casing 18 at the top, with the edges of the lid 60 resting on the upper edges of the casing 18.

Figure 4:
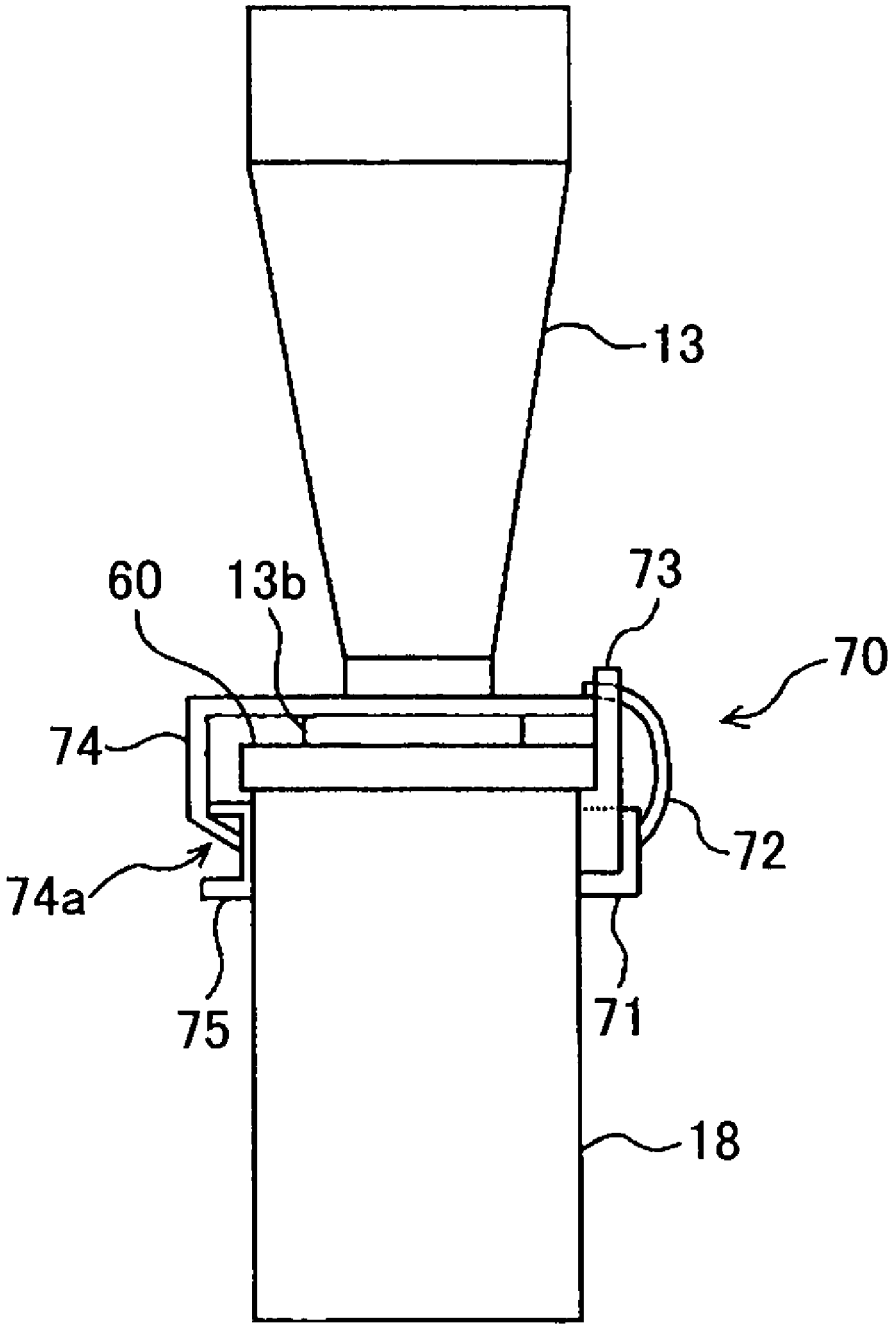
FIG. 4 depicts the collecting unit of FIG. 3 attached to a cyclone filter using a retaining unit.

As depicted in FIG. 2, the cyclone filter 13 has an opening 13*a* in a funnel-shaped outlet portion. The opening 13*a* is aligned with the opening 60*a* of the lid 60, thereby communicating the cyclone filter 13 and the collecting bag 19. With reference to FIG. 4, how the casing 18 is attached to the cyclone filter 13 is described. With the collecting bag 19 pressed from below against the cyclone filter 13, the casing 18 is retained on the cyclone filter 13 using a retaining unit 70. The retaining unit 70 includes a support member 71, a hook 72, two position regulating members 73, a fixing plate 74, and a U-shaped hooking member (plate) 75 fixed on the outside of the plate casing 18 near its top end. The two position regulating members 73 are mounted on the outside near the top of the casing 18, as depicted in FIGS. 3 and 4. The position regulating members 73, which partially protrude beyond the upper end of the casing 18, regulate the position of the casing 18 by abutting against the fixing plate 74, which is fixed to the casing of the image forming apparatus 100.

The support member 71 is mounted on an outer surface of the casing 18. The hook 72, which may include a steel bar bent in a required shape, is supported on one end by the support member 71. When attaching the casing 18 to the image forming apparatus 100, first, the U-shaped hooking member (plate) 75 is engaged with an end portion 74*a* of the fixing plate 74, which is fixed to the image forming apparatus casing. The unsupported, free end of the hook 72 is then fastened by placing it on top of the other end of the fixing plate 74. If a gap is formed between a rib 13*b* of the cyclone filter 13 and the lid 60, air leaks through it and the cyclone efficiency (sucking efficiency) decreases. Therefore, the lid 60 is pressed against the rib 13*b* of the cyclone filter 13 with a pressing force provided by the hook 72 such that no gap is formed between the rib 13*b* and the lid 60. When detaching the casing 18 from the image forming apparatus casing, the hook 72 is disengaged from the fixing plate 74 by rotating the hook 72 about its support at the support member 71.

When the collecting bag 19 is filled with waste toner, the casing 18 with the collecting bag 19 in it may be removed outside the image forming apparatus 100, and the collecting bag 19 alone may be replaced with a new one, recycling the casing 18. Alternatively, both the casing 18 and the collecting bag 19 may be replaced with new ones. When the amount of waste toner collected in the collecting bag 19 is full or nearly full, a message may be displayed on a display unit (not shown) of the image forming apparatus 100, prompting the user to replace the collecting bag 19.

Figure 5:
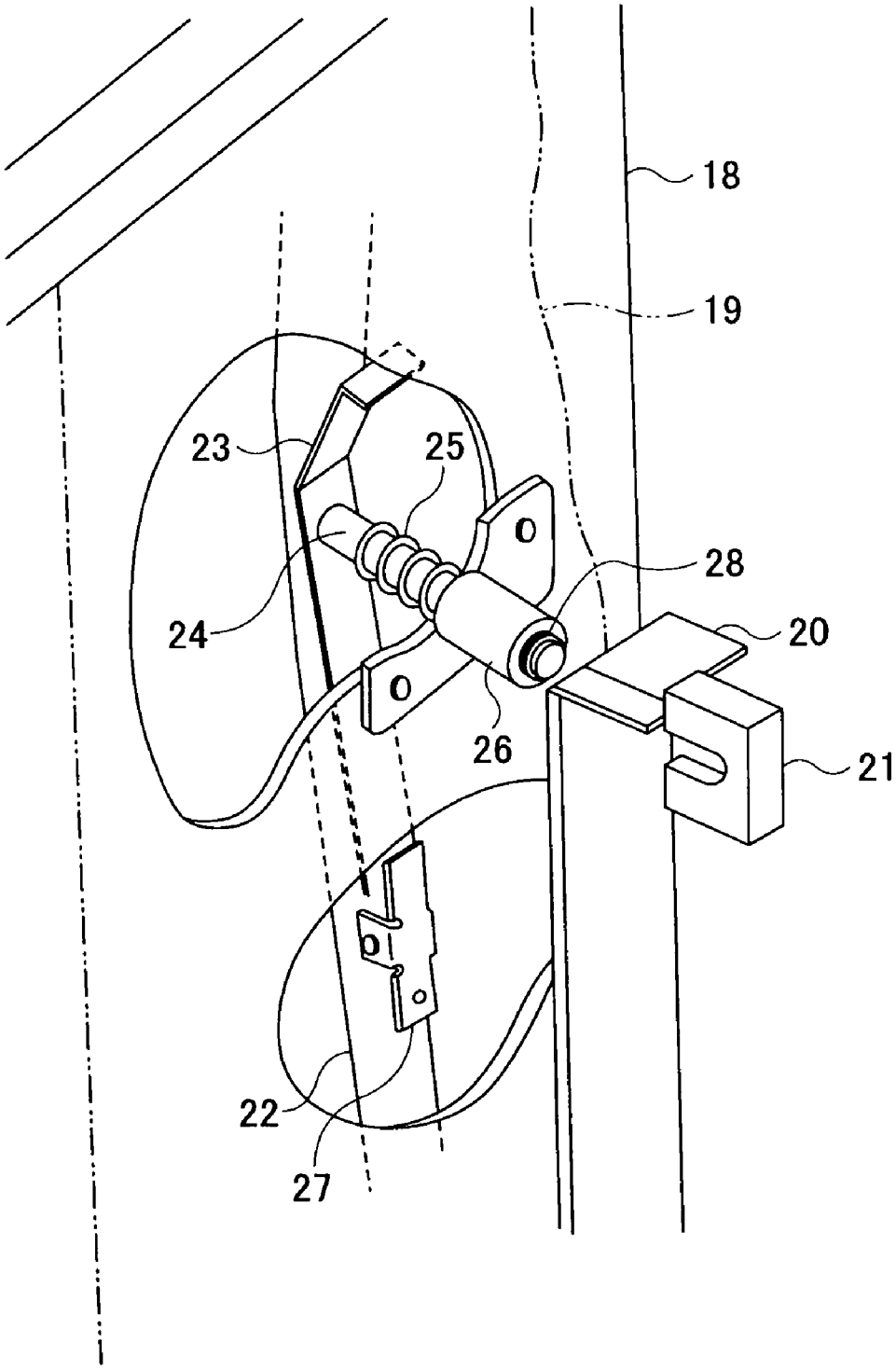
FIG. 5 is a perspective view of a main portion of the collecting unit.
Figure 6:
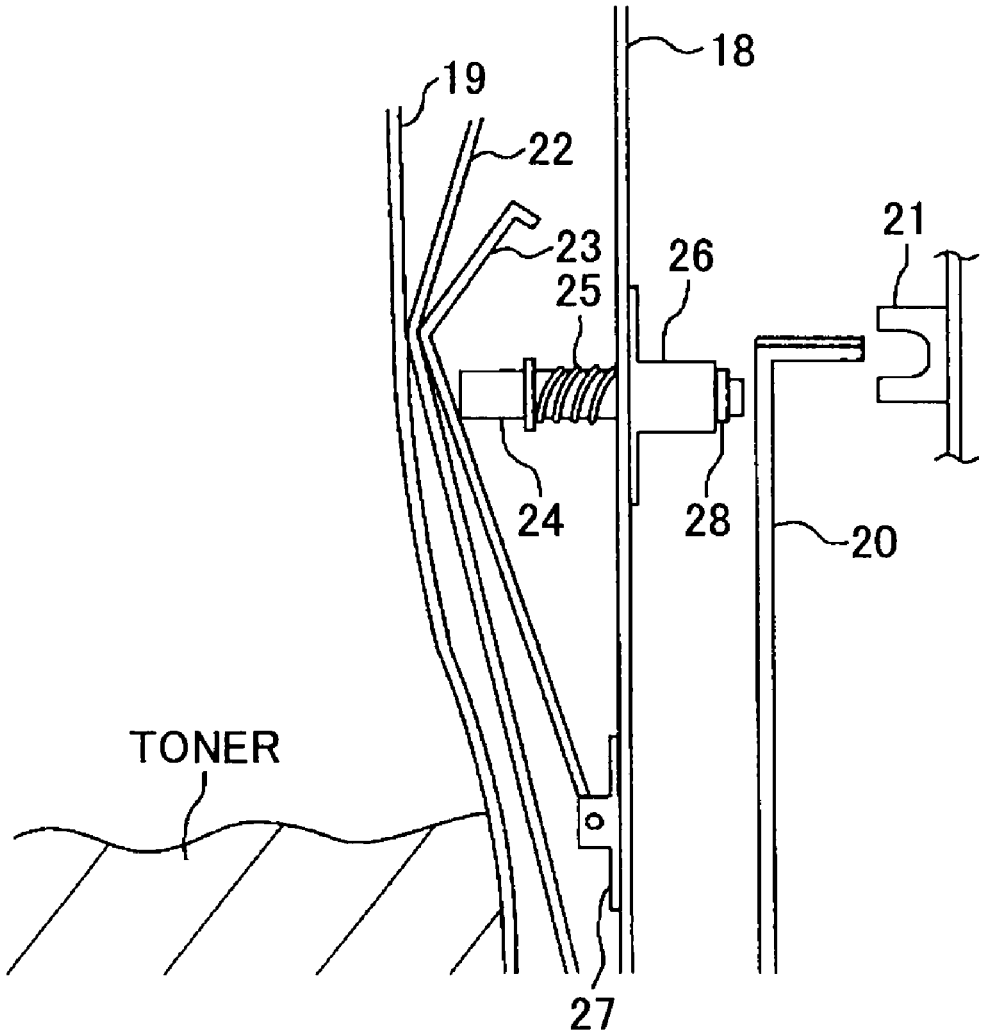
FIG. 6 is a cross section of the main portion of the collecting unit when the collecting bag is about half full.
Figure 7:
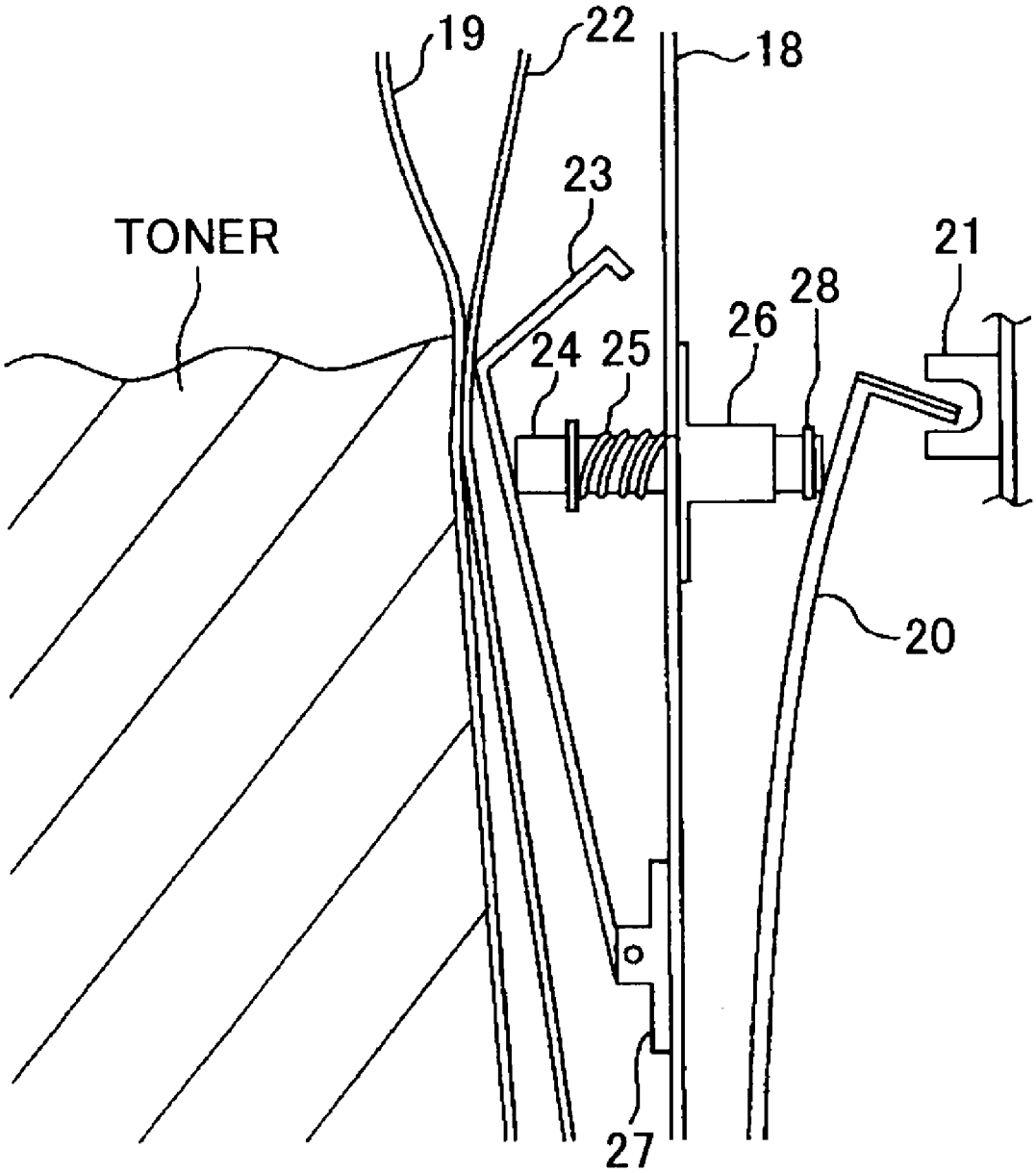
FIG. 7 is a cross section of the main portion of the collecting unit when the collecting bag is full.

FIGS. 5 through 7 depict a waste toner amount detecting mechanism according to an embodiment of the present invention. The casing 18 is formed of a relatively rigid material, such as plastic, so that it does not deform easily. On the other hand, the collecting bag 19 accommodated within the casing 18 is made of a relatively soft material, such as paper or unwoven fabric, so that it can be easily deformed. Such a soft and easily deformable material allows the collecting bag 19 to be readily inflated as it is loaded with waste toner, as will be seen from FIGS. 6 and 7. In the case of unwoven fabric, the collecting bag 19 may have the air permeability (which is the time it takes for 100 ml of air to pass through a certain area at a certain pressure) of 0.1 sec/100 ml.

A guide sheet 22, which may be made of plastic, may be fixed between the collecting bag 19 and the casing 18. The material of the guide sheet 22 is not limited to plastics and may be any material that can be easily deformed, such as paper. The function of the guide sheet 22 will be described later.

Still referring to FIGS. 5, 6, and 7, an arm 23 ("displaced member") is movably attached to the casing 18 via a swing base 27 such that the arm 23 can swing relative to the casing 18. A tubular guide member 26 is also attached to the casing 18. A rod 24 ("displacement amount transmitting unit") is inserted in the tubular guide member 26. The rod 24 can be displaced by the swinging motion of the arm 23 in the horizontal direction while the rod 24 is guided by the inner walls of the tubular guide member 26. As depicted, the rod 24 is fitted with a spring 25 by which the rod 24 is biased toward the arm 23. On the end of the rod 24 opposite the end contacting the arm 23, a stopper ring 28 is attached to prevent the rod 24 from slipping out of the guide member 26.

The outer size of the collecting bag 19 may be smaller than that of the casing 18 by approximately 10%. The thickness of the casing 18 may be approximately 2 mm, while the thickness of the collecting bag 19 may be on the order of 0.1 mm. The height of the collecting bag 19 may be 300 mm.

FIG. 6 is a cross section when a small amount of waste toner is collected in the collecting bag 19. FIG. 7 is a cross section when the collecting bag 19 is filled, so that the collecting bag 19 is inflated. In FIG. 7, the arm 23 is pushed outward and displaced by the side walls of the collecting bag 19. This in turn pushes the rod 24 outward along the guide member 26. The rod 24 thus pushes a leaf spring 20 which may be fixed to a frame or the like of the collecting unit 17 at one end, thereby bending the leaf spring 20 toward a detector element 21 ("displacement amount detecting unit"). When the leaf spring 20 is thus deformed to a certain extent, the bent-end of the leaf spring 20 enters a detecting gap of the detector element 21, as depicted in FIG. 7. The detector element 21 may be configured to output a detection signal (not shown) upon the entry of the end of the leaf spring 20 into the detecting gap.

Thus, in accordance with the present embodiment, the amount of displacement of the arm 23 as a result of the inflation of the collecting bag 19 as it is filled with waste toner is detected by the detector element 21 via the rod 24 and the leaf spring 20. Alternatively, the amount of displacement of the rod 24 may be detected using a sensor in combination with the detector element 21, without using the leaf spring 20. Further alternatively, the amount of displacement of the arm 23 may be directly detected by placing the detector element 21 and/or a sensor within the casing 18, thus dispensing with not just the leaf spring 20 but also the rod 24.

Thus, in accordance with the present embodiment, the rod 24 is pressed against the L-shaped end of the leaf spring 20. Thus, the amount of displacement of the arm 23 that is transmitted via the rod 24 can be amplified by the leaf spring 20, thereby improving the accuracy of detection of the waste toner amount by the detector element 21.

The detector element 21 may be configured to produce a response signal when the waste toner collected in the collecting bag 19 reaches a certain amount, thereby enabling the image forming apparatus 100 to directly detect the collected amount of waste toner in the collecting bag 19 accurately. Because the detecting unit such as the detector element 21 does not need to be provided within the detachable casing 18, the connecting structure between the detector element 21 and a unit for determining the amount of collected waste toner ("collected amount detecting unit"), such as a control unit (not shown), can be simplified.

Figure 8:
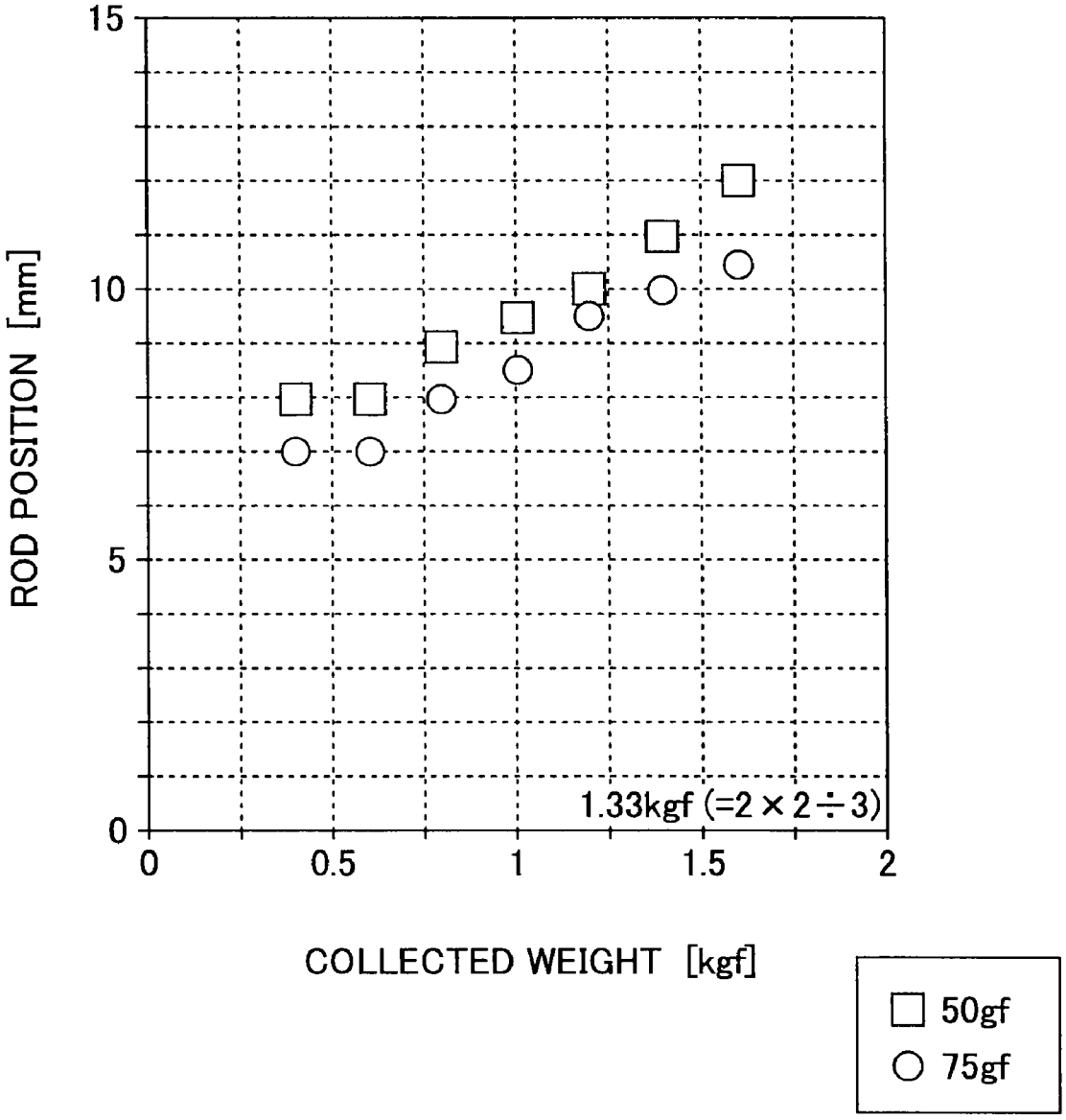
FIG. 8 is a graph illustrating a relationship between the weight of collected toner and the position of the rod.

FIG. 8 is a graph illustrating results of experiments conducted to determine the relationship between the weight of accumulated toner and the amount of displacement of the rod 24. As seen from FIG. 8, the accumulated amount of toner is substantially proportional to the amount of displacement of the rod 24. Based on such a relationship obtained from experiments, the collected amount of toner in the collecting bag 19 can be determined using a control unit or the like of the apparatus, which may include a CPU and a memory (not shown), by detecting the amount of displacement of the arm 23 using the detector element 21. The position of the detector element 21 may be set based on such a predetermined relationship between the collected amount of toner and the amount of displacement of the arm 23.

Because the image forming apparatus 100 directly detects the collected amount of waste toner in the collecting bag 19, the collected amount of waste toner in the collecting bag 19 can be detected accurately. Thus, whether the collecting bag 19 is filled with waste toner can be accurately determined.

By adjusting the point of contact of the detector element 21 to the leaf spring 20, the limit position of the waste toner amount can be varied. For example, the contact point of the detector element 21 is adjusted so that the detector element 21 can detect a nearly full state of the collecting bag 19. The accuracy of detection of the waste toner amount within the collecting bag 19 may be increased by providing a plurality of the toner amount detecting mechanism units including the arm 23, the rod 24, the leaf spring 20, and the detector element 21.

In accordance with the present embodiment, the arm 23 is biased against the collecting bag 19 by the force of the spring 25 via the rod 24. This prevents false detection of the waste toner collected amount by the inflation of the collecting bag 19, which may occur if the collecting bag 19 is inflated when in fact there is no waste toner in the collecting bag 19, such as when a new collecting bag 19 is attached. The collecting bag 19 may be so thin that a negative pressure can be produced around the collecting bag 19 with respect to the atmospheric pressure during a sucking operation of the cyclone filter 13.

When the casing 18 is attached to or detached from the apparatus main body, some of the toner that has attached to the connecting portion between the apparatus main body and the casing 18 may drop and land on areas around where the rod 24 or the guide member 26 are attached to the casing 18. Such toner may possibly attach to the outer surface of the rod 24 that is exposed out of the guide member 26. As a result, a smooth sliding movement of the rod 24 in the guide member 26 may be hindered, thereby preventing an accurate detection of the waste toner amount in the collecting bag 19 by the detector element 21.

Figure 9:
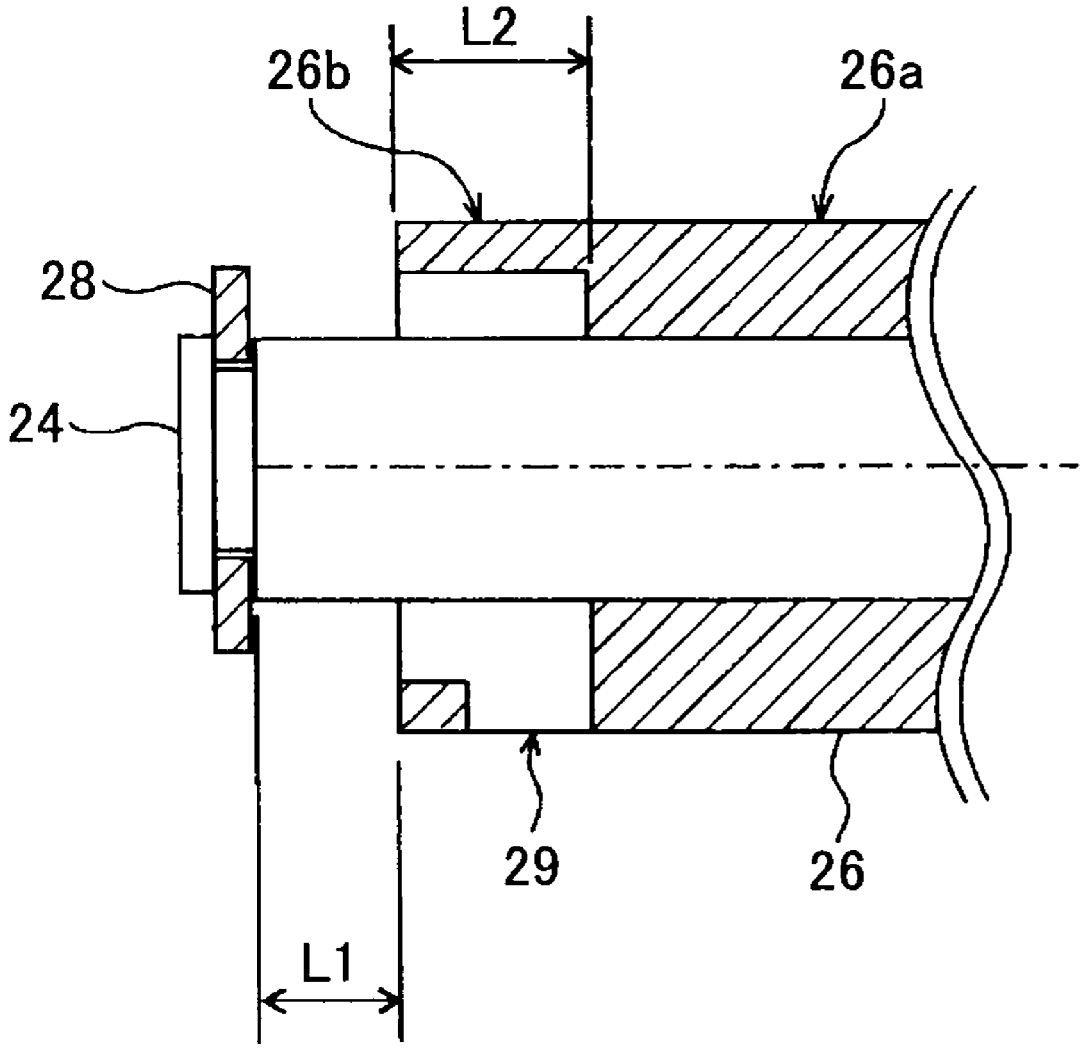
FIG. 9 is a cross section of a guide member for guiding the movement of a displacement amount transmitting unit.

FIG. 9 depicts a feature according to an embodiment of the present invention for preventing such a potential problem. The rod 24 depicted in FIG. 9 includes a contact portion 26*a* and a no-contact portion 26*b*. The contact portion 26*a* is where the outer circumferential surface of the rod 24 slides along the inner wall surface of the guide member 26. The no-contact portion 26*b* is located on an end portion of the guide member 26 opposite to the collecting bag 19 along the axial direction, i.e., toward the detector element 21. The no-contact portion 26*b* has a greater internal diameter than the contact portion 26*a* so that the outer circumferential surface of the rod 24 does not contact the internal wall of the no-contact portion 26*b*. The sliding movement of the rod 24 in the horizontal direction is thus guided by the internal wall of the contact portion 26*a* of the guide member 26.

A distance L1 of travel of the rod 24 is the distance between an initial position of the rod 24 where no waste toner is contained in the collecting bag 19 and a detected position of the rod 24 where a preset amount of waste toner is contained in the collecting bag 19 (such as when the collecting bag 19 is filled or nearly filled with waste toner). The distance L1 may be set to be smaller than a length L2 of the no-contact portion 26*b*. In this way, when toner attaches to the outer surface of the exposed portion of the rod 24 as described above, the outer surface of the rod 24 to which toner is attached can be prevented from reaching the contact portion 26*a* as the rod 24 moves back to the initial position from the detected position due to the force of the spring 25 when, for example, replacing the collecting bag 19. Thus, the resistance to the smooth movement of the rod 24 caused by the toner or the like attached to the rod 24 can be prevented.

A cutout 29 may also be provided in the side wall of the no-contact portion 26*b*, the cutout 29 forming a communicating channel between the inside and outside of the guide member 26 in the direction of gravity. The cutout 29 allows the toner or the like that has entered the no-contact portion 26*b* of the guide member 26 to be dropped outside due to the force of gravity. Thus, a large amount of toner or the like that has entered the no-contact portion 26*b* can be expelled via the cutout 29, thereby preventing the entry of the toner or the like into the contact portion 26*a* via the no-contact portion 26*b*.

Because the arm 23 is projecting toward the collecting bag 19 within the casing 18, as seen from, e.g., FIG. 5 or 6, the collecting bag 19 may be caught by the arm 23 when placing the collecting bag 19 within the casing 18. The problem would hinder and slow down the placing of the collecting bag 19 within the casing 18, or could even result in a puncture of the collecting bag 19 if it is ripped by the arm 23.

Thus, the guide sheet 22 made of a thin sheet of plastic for easy deformation may be disposed between the collecting bag 19 and the casing 18, as mentioned above. The guide sheet 22 allows the collecting bag 19 to be smoothly loaded, guiding the collecting bag 19 within the casing 18 without being caught by the arm 23. Thus, the loading of the collecting bag 19 is facilitated and the problem of ripping or puncture or the like of the collecting bag 19 by the arm 23 can be prevented.

Although this invention has been described in detail with reference to certain embodiments, variations and modifications exist within the scope and spirit of the invention as described and defined in the following claims.

The present application is based on the Japanese Priority Applications No. 2009-020589 filed Jan. 30, 2009 and No. 2009-249819 filed Oct. 30, 2009, the entire contents of which are hereby incorporated by reference.

What is claimed is:

1. A powder container apparatus for containing a powder material removed from a cleaned body using a cleaning unit, the powder container apparatus comprising:

a casing having an opening at the top;

a collecting bag made of a soft and freely deformable material detachably disposed within the casing, the collecting bag being configured to contain the powder material that is dropped via the opening of the casing;

a displaced member disposed between the collecting bag and the casing and configured to be horizontally displaced by the collecting bag when the collecting bag is inflated by the powder material contained in the collecting bag;

a displacement amount detecting unit configured to detect the horizontal displacement of the displaced member;

a displacement amount transmitting unit including a rod member disposed in an opening in a side wall of the casing, the displacement amount transmitting unit being configured to transmit the amount of horizontal displacement of the displaced member to the displacement amount detecting unit disposed outside the casing; and a hollow tubular guide member disposed on the side wall of the casing, the tubular guide member being configured to guide a horizontal movement of the rod member through the opening in the side wall of the casing, wherein an outer peripheral surface of the rod member slides on an internal wall surface of the tubular guide member, wherein the tubular guide member includes a contact portion where the outer peripheral surface of the rod member contacts the internal wall surface of the tubular guide member, and a no-contact portion where the rod member does not contact the internal wall surface of the tubular guide member, and wherein the contact portion is located closer to the inside of the casing than the no-contact portion is along an axis of the tubular guide member, wherein the no-contact portion along the axis of the tubular guide member is greater than the amount of displacement of the rod member.

2. The powder container apparatus according to claim 1, further comprising a biasing unit configured to bias the displacement amount transmitting unit toward the container.

3. The powder container apparatus according to claim 1, further comprising a sheet-like member made of a flexible material disposed between the collecting bag and the displaced member.

4. The powder container apparatus according to claim 1, wherein the tubular guide member includes a cutout provided in a side wall of the tubular guide member in the no-contact portion, the cutout providing a channel communicating with the inside and outside of the tubular guide member.

5. The powder container apparatus according to claim 1, further comprising a leaf spring member disposed between the displacement amount transmitting unit and the displacement amount detecting unit.

6. The powder container apparatus according to claim 1, wherein the cleaned body is a photosensitive body.

7. An image forming apparatus comprising:

an image carrier;

a cleaning unit configured to remove a powder material from a surface of the image carrier; and a powder collecting unit configured to collect the powder material removed by the cleaning unit, wherein the powder collecting unit includes the powder container apparatus according to claim 1.

8. The powder container apparatus according to claim 1, further comprising:

a collected amount detecting unit configured to determine a collected amount of the powder material in the collecting bag based on the horizontal displacement of the displaced member detected by the displacement amount detecting unit.

9. A powder container apparatus for containing a powder material, the powder container apparatus comprising:

a casing;

a collecting bag made of a soft and freely deformable material detachably disposed within the casing, the collecting bag being configured to contain the powder material;

a displaced member disposed between the collecting bag and the casing and configured to be displaced by the collecting bag when the collecting bag is inflated by the powder material contained in the collecting bag;

a displacement amount detecting unit configured to detect displacement of the displaced member;

a displacement amount transmitting unit disposed in an opening in a wall of the casing, the displacement amount transmitting unit including a rod and being configured to transmit the amount of displacement of the displaced member to the displacement amount detecting unit disposed outside the casing; and a hollow tubular guide member disposed on the wall of the casing, the tubular guide member being configured to guide a movement of the rod member through the opening in the wall of the casing, wherein an outer peripheral surface of the rod member slides on an internal wall surface of the tubular guide member, wherein the tubular guide member includes a contact portion where the outer peripheral surface of the rod member contacts the internal wall surface of the tubular guide member, and a no-contact portion where the rod member does not contact the internal wall surface of the tubular guide member, and wherein the no-contact portion along the axis of the tubular guide member is greater than an amount of displacement of the rod member.

10. A powder container apparatus for containing a powder material, the powder container apparatus comprising:

a casing;

a collecting bag made of a freely deformable material detachably disposed within the casing, the collecting bag being configured to contain the powder material;

a displaced member disposed between the collecting bag and the casing and configured to be displaced by the collecting bag when the collecting bag is inflated by the powder material contained in the collecting bag;

a displacement amount detecting unit configured to detect displacement of the displaced member;

a displacement amount transmitting unit disposed in an opening in a wall of the casing, the displacement amount transmitting unit including a rod and being configured to transmit the displacement of the displaced member to the displacement amount detecting unit disposed outside the casing.

11. A powder container apparatus for containing a powder material, the powder container apparatus comprising:

a casing;

a collecting bag made of a freely deformable material detachably disposed within the casing, the collecting bag being configured to contain the powder material;

a displaced member disposed between the collecting bag and the casing and configured to be displaced by the collecting bag when the collecting bag is inflated by the powder material contained in the collecting bag;

a displacement detecting unit configured to detect displacement of the displaced member;

a displacement transmitting unit disposed in an opening in a wall of the casing, the displacement transmitting unit including a rod and being configured to transmit the displacement of the displaced member to the displacement detecting unit disposed outside the casing.

12. The powder container apparatus of claim 10, further comprising:

a second displacement amount detecting unit to detect displacement of a second displaced member; and a second displacement amount transmitting unit disposed in an opening in a wall of the casing, the second displacement amount detecting unit including a rod and being configured to transmit the displacement of the second displaced member to the second displacement amount detecting unit.

* * * * *